US006829994B2

(12) United States Patent
Veil

(10) Patent No.: US 6,829,994 B2
(45) Date of Patent: Dec. 14, 2004

(54) METHOD AND APPARATUS FOR PRINTING ON SUBSTRATES FOR PREPARING PACKAGING BLANKS

(75) Inventor: Jürgen Veil, Dresden (DE)

(73) Assignee: Koenig & Bauer, Wurzburg (DE)

( * ) Notice: Subject to any disclaimer, the term of this patent is extended or adjusted under 35 U.S.C. 154(b) by 4 days.

(21) Appl. No.: 10/054,292

(22) Filed: Nov. 13, 2001

(65) Prior Publication Data

US 2002/0134260 A1 Sep. 26, 2002

(30) Foreign Application Priority Data

Nov. 16, 2000 (DE) ..... 100 57 644

(51) Int. Cl.[7] ..... B41F 3/52; B41F 5/02; B41F 3/34

(52) U.S. Cl. ..... 101/424.1; 101/450.1; 101/142

(58) Field of Search ..... 101/135, 136, 101/450.1, 451, 216, 217, 141, 142, 424.1

(56) References Cited

U.S. PATENT DOCUMENTS 2,008,974 A * 7/1935 Weber ..... 156/207
4,841,903 A * 6/1989 Bird ..... 118/46
5,233,762 A * 8/1993 Muller et al. ..... 34/246
5,638,752 A * 6/1997 Hartung et al. ..... 101/177
6,443,058 B1 * 9/2002 Stadler et al. ..... 101/23

* cited by examiner

*Primary Examiner*—Daniel J. Colilla
(74) *Attorney, Agent, or Firm*—Goodwin Procter LLP

(57) ABSTRACT

The present invention relates to a method and apparatus for printing on a substrate for preparing packaging blanks. The substrate is divided into copies, each of these copies having one or more areas for subsequent application of an adhesive, and a printed image produced on the copy by application of an ink film and coated with a lacquer.

It is an object of the present invention to develop a method and apparatus for printing on a substrate for preparing packaging blanks, for which specially manufactured lacquer plates are not required.

Pursuant to the present invention, this object is accomplished based on the fact that an ink film and a binder customarily used for offset printing inks are used to produce a printed image on a substrate and a lacquer is applied over the surface of the substrate, wherein the binder is applied at areas intended for application of an adhesive and the lacquer is absorbed by the binder.

13 Claims, 2 Drawing Sheets

METHOD AND APPARATUS FOR PRINTING ON SUBSTRATES FOR PREPARING PACKAGING BLANKS

FIELD OF THE INVENTION

The invention relates to a method and apparatus for printing on a substrate for preparing packaging blanks. The substrate is divided into copies, each of these copies having one or more areas for application of an adhesive, and a printed image which is produced on the copy by application of an ink film and coated with a lacquer.

BACKGROUND OF THE INVENTION

For lacquering surfaces of substrates in the packaging industry, it is customary to use printing plates made for this purpose as lacquering plates. These lacquering plates are provided with partial recesses in order to keep adhesive flaps of packaging blanks free of lacquer. This procedure was introduced in the book entitled "Offsetdrucktechnik" (Offset Printing Technology) by Helmut Teschner, $9^{th}$ Edition, 1995, pages 11–43. It is a disadvantage that special lacquer plates are required, which are expensive to manufacture.

SUMMARY OF THE INVENTION

It is an object of the present invention to develop a method and apparatus for printing on a substrate for preparing packaging blanks, for which specially manufactured lacquer plates are not required.

Pursuant to the present invention, this object is accomplished by the distinguishing features as claimed.

The present invention has the advantage that a single lacquer plate can be used for several printing applications. This lacquer plate is free of partial recesses. As a result, the manufacturing costs can be reduced greatly. Since the lacquer plate can be used for several printing applications, the changeover times can also be shortened. Moreover, only one lacquering unit or lacquer tower is required.

BRIEF DESCRIPTION OF THE DRAWINGS

The invention is described in greater details by means of examples with reference to the following drawings.

DETAILED DESCRIPTION OF THE INVENTION

Example 1

Figure 1:
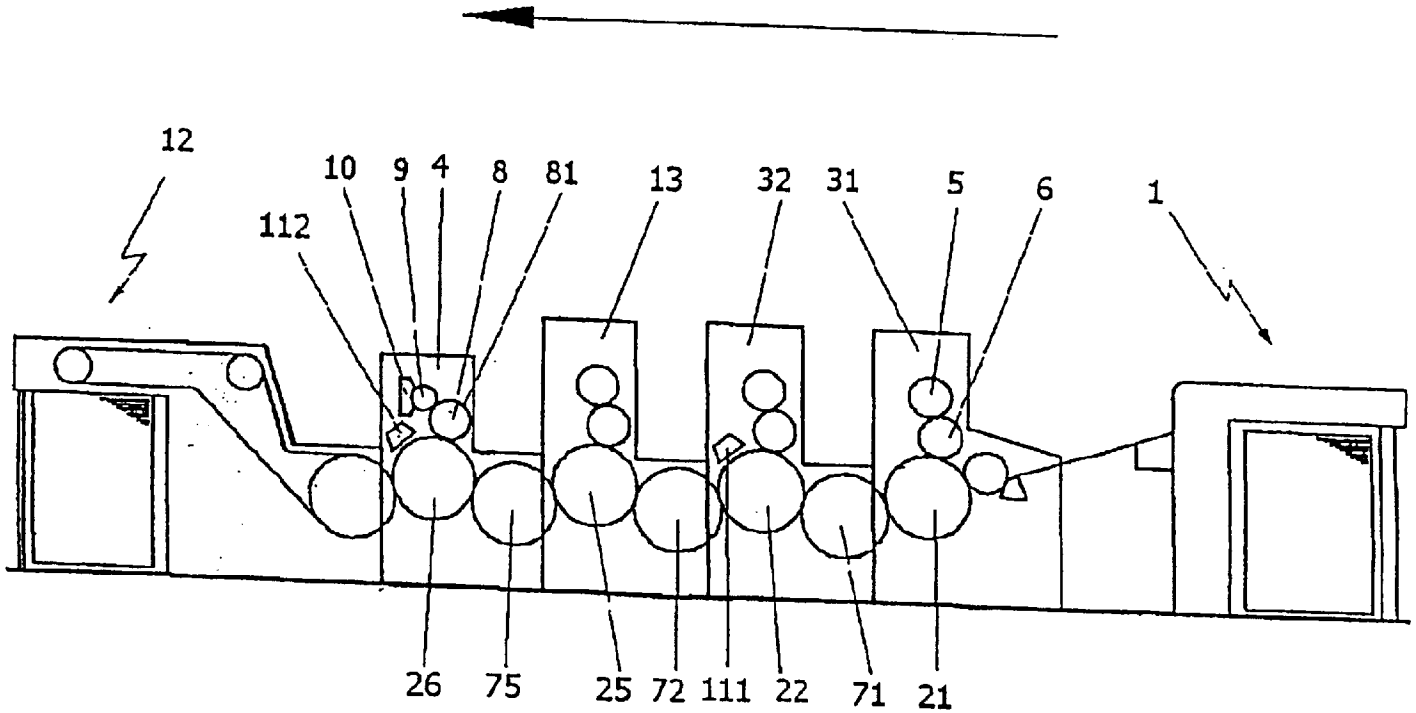
FIG. 1 shows a diagrammatic representation of a sheet-fed offset printing press with three printing units.

As can be seen from FIG. 1, this sheet-fed printing press comprises printing units 31, 32, 13, which are disposed in series. In FIG. 1, three printing units 31, 32, 13 are shown as an example. The method of the present invention can also be carried out with only two printing units.

A feeding apparatus 1 precedes the printing units 31, 32, 13. The construction and function of the feeding unit 1 are known so that it is unnecessary to go into detail herein. Each of the printing units 31, 32, 13 comprises a back-pressure roll 21, 22, 25, a plate cylinder 5 and a rubber-covered cylinder 6. In FIG. 1, the plate cylinder 5 and the rubber covered cylinder 6 are labeled only in the printing unit 31. The direction in which sheets move is indicated by an arrow. Furthermore, each of sheet-guiding cylinders 71, 72 is in contact with two of the back-pressure rolls 21, 22, 25 and may be constructed as a turning drum and used in face printing and perfecting printing. The back-pressure rolls 21, 22, 25 and the sheet-guiding cylinders 71, 72 are sheet-guiding cylinders with twice the diameter. Tinting units and damping units belonging to each printing unit 31, 32 are not shown in FIG. 1. A dryer 111 may be assigned to the printing unit 31.

The printing units 31, 32 are intended for printing an ink system which contains printing inks with radiation-drying, usually UV-drying components. It is, however, also possible to use the printing units for printing other inks. These printing inks may be, for example, printing inks typical for offset printing.

The printing unit 13, which is intended for coating the surfaces of the copies intended for application of an adhesive, is disposed after the printing unit 32.

In the direction in which the sheets are moving, a lacquer tower 4 for coating the printed image with a layer of lacquer is disposed after the printing unit 13. This layer of lacquer can also be dried by radiation. The lacquer tower 4 comprises a back-pressure roll 26, to which a lacquer plate cylinder 8 is assigned. A lacquer plate 81 is clamped on the lacquer plate cylinder 8. A sheet-guiding cylinder 75 precedes the back-pressure roll.

An engraved ink transfer cylinder roll 9 is assigned to the lacquer plate cylinder 8 or the lacquer plate 81. A chamber doctor blade 10 is used for supplying lacquer to the engraved ink transfer cylinder roll 9. Furthermore, a dryer 112 is assigned to the lacquer tower 4.

A delivery end 12 is provided after the lacquer tower 4. The construction and function of the delivery end 12 are known so that they are not described in detail herein.

The method of the present invention described below may be realized with the apparatus shown in FIG. 1.

A sheet to be printed is fed to the feeding apparatus 1 and taken hold of by the apparatus, the details of which are not described herein, and put into motion in the direction of the arrow. In the printing units 31, 32, a first ink system is applied over the rubber-covered cylinder 6. The ink system is understood to be a combination of inks, which have essentially the same processing properties.

The ink system used in the printing units 31, 32 may contain an ink which cures under radiation, for example, under UV radiation. Such inks are referred to as hybrid inks. It is, however, also possible to use inks which are typically used for offset printing, or other inks, such as pure UV inks.

Optionally, the inks can be dried by the dryer 111.

In the printing unit 13, a second ink system is applied on the surfaces provided for application of an adhesive. This ink system contains only a small amount of pigments or substantially no pigments at all.

In the lacquer tower 4, the surface of the substrate is coated with a colorless lacquer. The lacquer used for this purpose has the property of interacting differently with the ink systems applied. This takes place due to the fact that the lacquer is absorbed by the coating (the second ink system) of the surface intended for application of an adhesive. However, the lacquer remains largely on the other surface applied with inks of the first inking system, and endows the surface with a gloss.

It is a prerequisite for the occurrences of the above effect that the two inking systems differ from one another with regard to lacquer-absorption capability. The degree of gloss is inversely proportional to the capacity of the ink system to absorb lacquer, so that more lacquer remains on surfaces of ink layers with ink systems of lower absorptive capacities, and more lacquer is absorbed by ink layers with ink systems of higher absorptive capacities. The gloss-determining components of the lacquer can be taken up by the ink layers. Thus, the coating forms a suitable substrate for subsequent application of an adhesive.

Example 2

The construction of the sheet-fed printing press for realizing the method of example 2 corresponds largely to the configuration shown in FIG. 1.

Instead of a second ink system, a binder customarily used in offset printing, usually a varnish, is printed by the printing unit 13.

When the lacquer is applied over the surface of the substrate in the lacquer tower 4, the effect resulted from absorption of the lacquer by the ink systems as described above also occurs here when a binder is used.

Example 3

Figure 2:
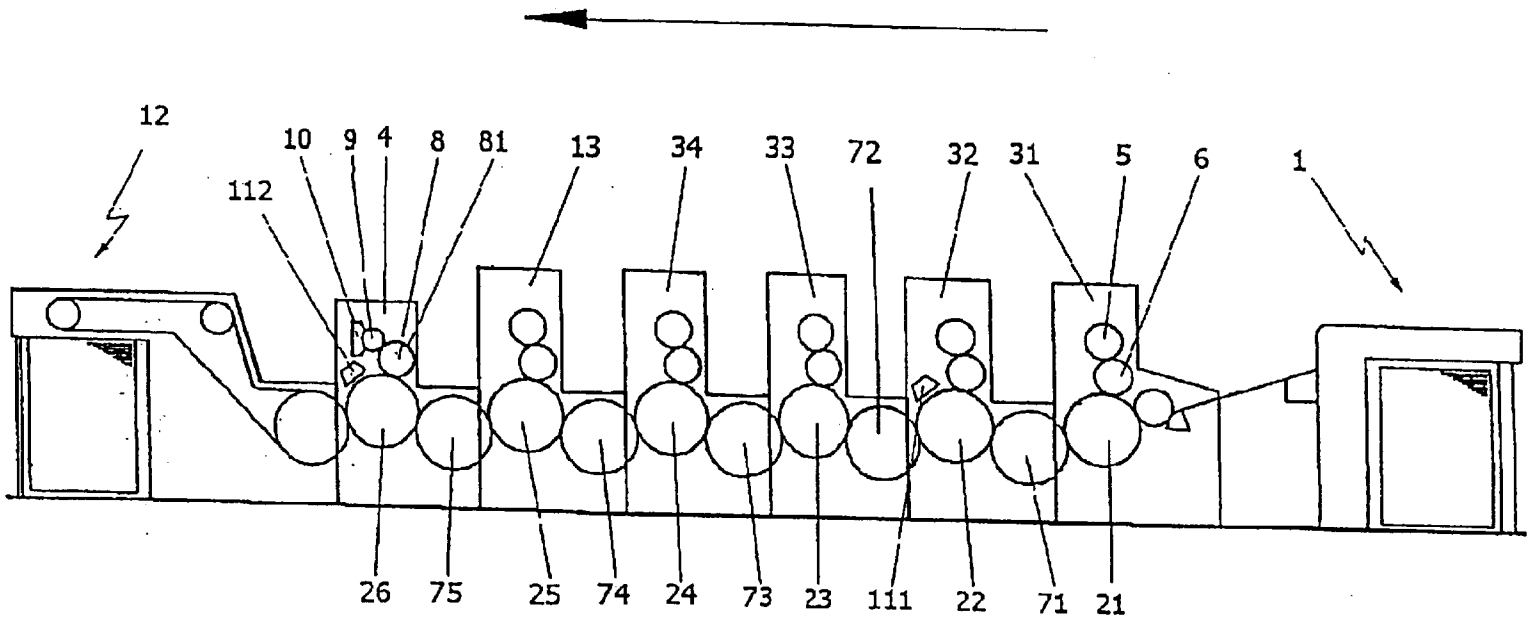
FIG. 2 shows a diagrammatic representation of a sheet-fed offset printing press with five printing units.

As is evident from FIG. 2, two printing units 31, 32 for printing a first ink system are disposed in this example. A dryer 111 may be assigned to the printing unit 32. Two additional printing units 33, 34 for printing an additional ink system and a printing unit 13 are disposed after the printing units 31, 32. As in the preceding examples, the series of printing units also ends at a lacquer tower 4.

With this configuration, the following method is realized:

The printed image desired for a corresponding packaging is applied by the printing units 31, 32. In this connection, a layer of inks comprising inks of a first ink system is applied in the printing units 31, 32. This layer may be composed of hybrid inks, which is understood to be inks comprising at least some ink which can be cured by radiation (especially by UV radiation). These inks are dried in the printing unit 31 by a dryer 111, which is constructed as a UV radiator.

The printing units 33, 34 are used for printing an ink system, which comprises inks typically used for offset printing. These inks do not have to be dried by an appropriate device.

In the printing unit 13, a binder which is customarily used in offset printing, usually a varnish, is applied on the areas intended for application of an adhesive.

Subsequently, the surface of the substrate is coated in the lacquer tower 8 with a closed layer of lacquer. The lacquer is absorbed by the coating of the areas intended for application of an adhesive. The other areas of the copy are coated with different ink systems by the printing units 31, 32, 33, 34. Due to different lacquer absorptive capacities of the ink systems, the lacquer is absorbed by these areas in different amounts. As a result, different degrees of gloss can be achieved.

What is claimed is:

1. A method for printing on a printing substrate having a surface for preparing packaging blanks, comprising the steps of:

dividing said printing substrate into a plurality of blank substrates for printing, said blank substrates having areas intended for application of an adhesive;

producing a printed image on each of said blank substrates by application of an ink film of a first ink system;

coating said areas intended for application of an adhesive with a second ink system; and applying a lacquer over said surface of said printing substrate, said lacquer being absorbed by said coating of said areas intended for application of an adhesive, whereby said areas intended for application of an adhesive form substrates for application of an adhesive;

wherein said ink systems differ from one another with respect to lacquer absorption capacities.

2. The method of claim 1, wherein said ink systems, after being applied, are treated differently by curing and/or drying.

3. The method of claim 1, wherein said ink system for coating said areas intended for application of an adhesive contains only a small amount of pigments or substantially no pigments at all.

4. The method of claim 1, wherein said lacquer is colorless.

5. The method of claim 1, wherein said first ink system comprises a hybrid ink, which contains an ink which can be cured by radiation, or comprises an offset ink.

6. The method of claim 5, wherein said hybrid ink and said lacquer are cured by UV light.

7. The method of claim 1, wherein said lacquer is cured by radiation.

8. A method for printing on a printing substrate having a surface for preparing packaging blanks, comprising the steps of:

dividing said printing substrate into a plurality of blank substrates for printing, said blank substrates having areas intended for application of an adhesive;

producing a printed image on each of said blank substrates by application of an ink film;

applying a binder for offset printing inks at said areas intended for application of an adhesive; and applying a lacquer over said surface of said printing substrate, said lacquer being absorbed by said binder, whereby said areas intended for application of an adhesive form substrates for application of an adhesive;

wherein said ink film and said binder differ from one another with respect to lacquer absorptive capacities.

9. The method of claim 8, wherein said binder for offset printing inks is a varnish.

10. The method of claim 8, wherein said ink film and said binder are treated differently by curing and/or drying.

11. A method for printing on a printing substrate having a surface for preparing packaging blanks, comprising the steps of:

dividing said printing substrate into a plurality of blank substrates for printing, said blank substrates having areas intended for application of an adhesive;

producing a printed image on each of said blank substrates by application of at least two different ink systems;

applying a binder for offset printing inks at said areas intended for application of an adhesive; and applying a lacquer over said surface of said printing substrate, said lacquer being absorbed by said binder and interacting with said at least two different inks systems, whereby said areas intended for application of an adhesive form substrates for application of an adhesive and degrees of gloss vary among areas of said at least two different ink systems.

12. The method of claim 11, wherein said degrees of gloss are inversely proportional to lacquer absorptive capacities of said ink systems so that more lacquer remains at a surface of ink systems of lower lacquer absorptive capacities and less lacquer remains at a surface of ink systems of higher lacquer absorptive capacities.

13. A method of claim 12, wherein one or more gloss-determining components of said lacquer can be absorbed by said ink systems.

* * * * *